US010336662B1

(12) United States Patent
Mannion et al.

(10) Patent No.: US 10,336,662 B1
(45) Date of Patent: Jul. 2, 2019

(54) AMMONIUM NITRATE PRILL HAVING A NON-HYGROSCOPIC SHELL

(71) Applicant: Department of the Navy, Washington, DC (US)

(72) Inventors: Joseph D Mannion, Washington, DC (US); John P Consaga, Diamond Point, NY (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 215 days.

(21) Appl. No.: 15/330,472

(22) Filed: Sep. 26, 2016

(51) Int. Cl.
*C06B 45/32* (2006.01)
*C06B 31/30* (2006.01)

(52) U.S. Cl.
CPC ..... *C06B 45/32* (2013.01); *C06B 31/30* (2013.01)

(58) Field of Classification Search
CPC ..... C06B 45/32; C06B 31/30
See application file for complete search history.

(56) References Cited

U.S. PATENT DOCUMENTS

| | | | |
|---|---|---|---|
| 3,264,088 | A | 8/1966 | Hansen et al. |
| 5,698,002 | A | 12/1997 | Hudson |
| 7,081,175 | B2 | 7/2006 | Serizawa et al. |
| 7,267,707 | B2 | 9/2007 | Rosenthal et al. |
| 7,452,399 | B2 | 11/2008 | Whittington |
| 2002/0007885 | A1 | 1/2002 | Serizawa et al. |

OTHER PUBLICATIONS

NIH: Naming and Chemistry of Araldite AY 238; Araldite XU AY 238; Araldite EPS 104; 5-Ethyl-1,3-diaglycidyl-5-methylhydantoin.

*Primary Examiner* — Aileen B Felton
(74) *Attorney, Agent, or Firm* — Fredric J. Zimmermann

(57) ABSTRACT

The invention is an article of manufacture, a composition of matter and an in-situ process for making non-hygroscopic ammonium nitrate prills. The non-hygroscopic prills are formed from dried prills of ammonium nitrate, in reaction vessel having an inert gas atmosphere and a nonpolar reaction diluent. A shell is formed in situ by reacting a first reactant with a second reactant in the presence of the AN prills en masse. The prills, en masse, are individually sealed in the shell made of a highly crosslinked polymeric material. The material is a reaction product of a diglycidyl hydantoin and a polyoxypropylene-triamine.

18 Claims, 7 Drawing Sheets

$R_3$ & $R_4$ =

AMMONIUM NITRATE PRILL HAVING A NON-HYGROSCOPIC SHELL

STATEMENT OF GOVERNMENT INTEREST

The invention described herein may be manufactured and used by or for the Government of the United States of America for Governmental purposes without the payment of any royalties thereon or therefore.

BACKGROUND OF THE INVENTION

1. Field of the Invention

The present invention is a process and a product for a shell, and more particularly a sealing non-hygroscopic shell encasing an ammonium nitrate prill where the shell excludes water and water vapor, it is compatible with polyurethanes, and the shell is formed in situ as a highly cross-linked coating.

2. Prior Art

Ammonium Nitrate (AN) is hygroscopic, and it is highly soluble in water, which typically precludes its preparation through crystallization, as recrystallization of AN by slow evaporation of aqueous solutions produces needle-like crystals. The needle like crystals are unsuitable in explosives as they cannot be efficiently packed as an explosive, and in agricultural applications the needle-like crystals cannot be uniformly distributed efficiently. A porous prill is desired for military grades, and a granular form is used in most commercial applications. The highly hygroscopic nature of AN causes both grades to agglomerate, as they age, even in relatively low humidity. Agglomeration changes the way the explosive burns, which increases its propensity to surge. Current examples of the devastating effect of agglomeration include defective air bags, and the explosion of the fertilizer company in West, Texas in 2013, killing 15 people.

To prevent agglomeration historically AN has been treated with additives and/or coating agents. Examples include dry clay (e.g. kaolinite and talc). Prills are less susceptible than granules, but are still susceptible to ambient humidity, and can cake as they age.

Ammonium nitrate is used as a combustible component for munitions and the inflation of air bags, and historically, it has been found that over time it behaves erratically and typically does not age well. Ammonium nitrate's strong hygroscopic nature is believed to be an underlying cause for its instability. There have been several unsuccessful attempts to treat ammonium nitrate in an effort to eliminate its hygroscopic property, therein imparting long term stability. To date a satisfactory solution has not been found.

SUMMARY OF THE INVENTION

The invention is an article of manufacture, a composition of matter and a process for forming a sealing non-hygroscopic shell encasing an ammonium nitrate (AN) prill, where the shell excludes water and water vapor, and the shell is compatible with polyurethanes. The resultant article is a dried prill of ammonium nitrate sealed in a shell comprised of a highly crosslinked polymeric material, where the material is a reaction product of a diglycidyl hydantoin and a polyoxypropylenetriamine. Generally, a "prill" is a solid, spherical granule formed in a melt-spray crystallization process.

An aspect of the invention is that the shell is formed in situ as a highly cross-linked coating, where the shell is not friable, adding resilience to the prill so that normal handling of the encased AN prill causes less diminution of the prill. AN prills may be packed more densely than granular material, and in particular, more dense than needle-like AN material derived from needle-like crystals. A higher level of packing enables a more powerful explosion.

Another aspect of the invention is that the shell weight is less than about 5% of the weight of the AN prill.

Another aspect of the invention is that the shell is formed in situ by reacting a first reactant with a second reactant in the presence of the AN prills en masse. The first reactant has a moiety with an affinity for AN and at least two epoxy groups. The first reactant, dissolved in a solvent, is incrementally added to a gently mixed slurry of the AN prills covered by a relatively nonpolar reaction diluent. Upon being added to the nonpolar reaction diluent covering the AN prills, the first reactant deposits onto the surface of the prills. The second reactant has at least two nucleophilic groups, where each nucleophilic group can react with at least one epoxy group.

After a few minutes, the second reactant is also incrementally added to the nonpolar reaction diluent covering the AN prills, where the prills are at least partially coated with the first reagent. Following heating and gentle mixing for a time, the first and second reactants react forming the highly crosslinked polymeric shells, where each prill is encased in a shell having a shape that is specifically suited for each individual prill. Prills can range substantially in size and surface shape.

An object of the invention is to provide a process where substantially all of the first and second reactants may be accounted for in the highly crosslinked polymeric shells.

A second object of the invention is that the highly crosslinked polymeric shells have pendant hydroxyl groups, to which urethanes and isocyanate groups in particular are compatible and even reactive.

BRIEF DESCRIPTION OF THE DRAWINGS

The foregoing invention will become readily apparent by referring to the following detailed description and the appended drawings in which.

DETAILED DESCRIPTION OF THE INVENTION

The invented article of manufacture has a unique composition of matter, where the composition of matter is attained using a process that en masse forms a sealing non-hygroscopic shell, which individually encases, that is, encapsulates and surrounds, each of the ammonium nitrate (AN) prills. The prill is generally a solid, spherical, granular shape. The shell excludes water and water vapor. The shell is formed in situ by reacting a first reactant with a second reactant in the presence of the AN prills en masse. The en masse process forms the resultant articles of manufacture, which are individual dried prills of ammonium nitrate sealed in a shell comprised of a highly crosslinked polymeric material, where the material is a reaction product of a diglycidyl hydantoin and a polyoxypropylenetriamine The en masse process is possible, in large part, by utilizing a first reagent that has a strong affinity for the AN prill.

Figure 1:
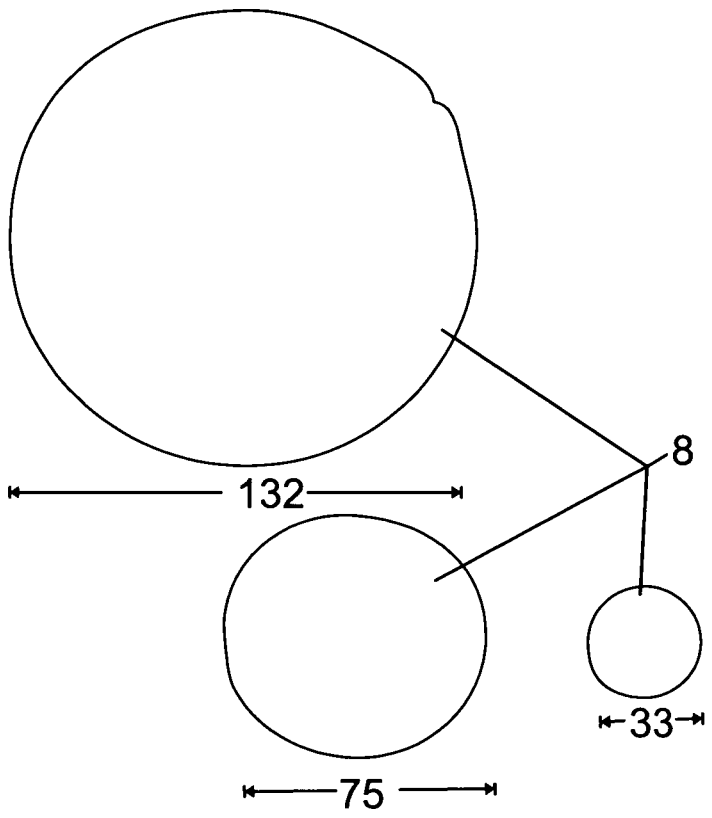
FIG. 1 is a diagrammatic view of prilled AN, illustrating that the substantially spherical prill may be various sizes, where the illustrated prills have a range in diameter from about 132 microns, and about 75 microns to about 33 microns.
Figure 2:
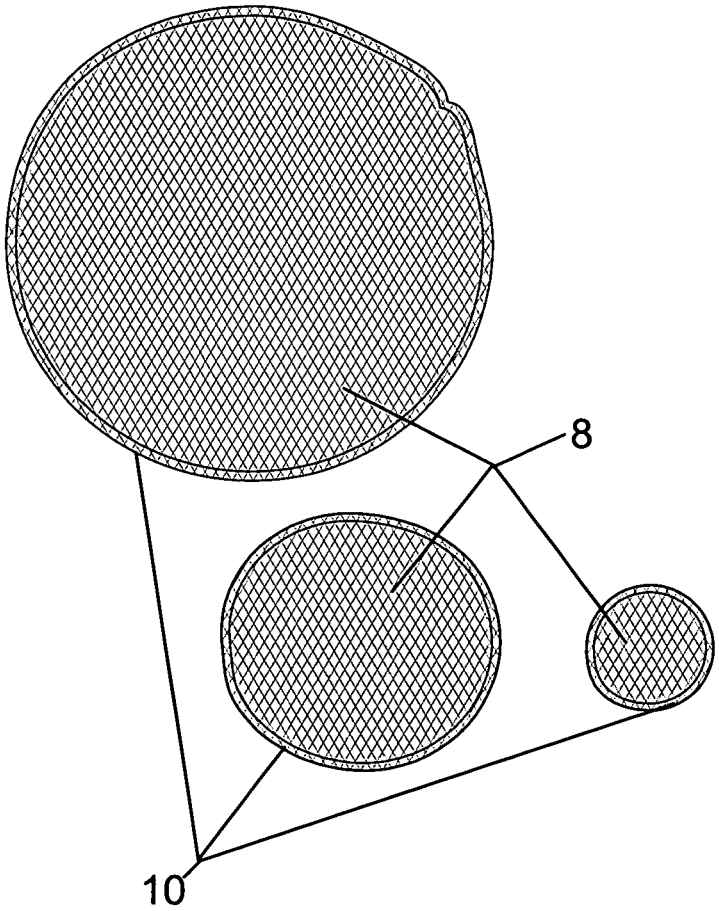
FIG. 2 is a diagrammatic view of the prilled AN illustrated in FIG. 1, wherein the illustrated prilled AN has a substantially resilient shell that is uniquely shaped for each prill and where the shell has a thickness that is about the same, regardless of the dimensions of the AN prill.
Figure 3:
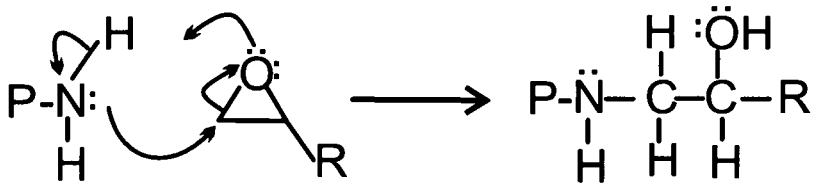
FIG. 3 is illustrates a likely mechanism for the reaction between a nucleophilic group that is an amine and an epoxide.
Figure 5C:
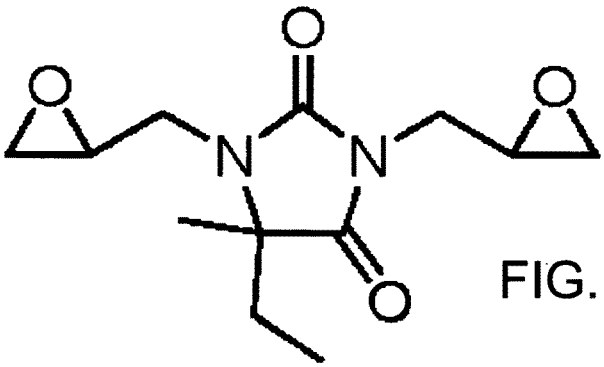
FIG. 5*c* a specific first reagent, which is 5-ethyl-1,3-diglycidyl-5-methylhydantoin.
Figure 5B:
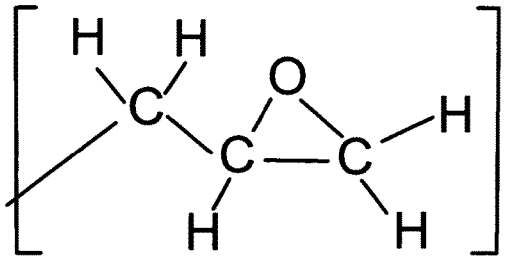
FIG. 5*b* illustrates a pair of glycidyl groups attached to the hydantoin moiety of the first reagent.
Figure 5A:
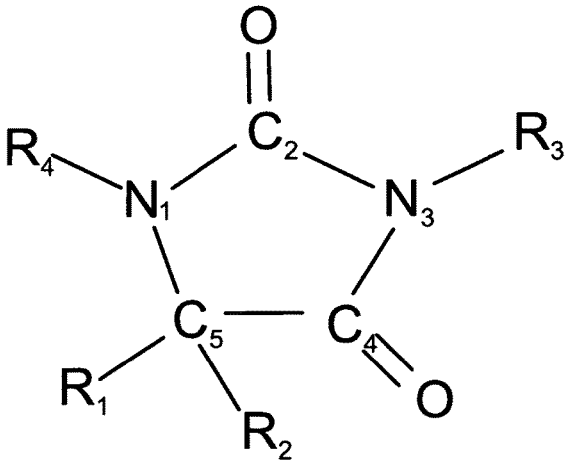
FIG. 5*a* illustrates a generalized hydantoin moiety of the first reagent.

The strong affinity is due to the presence of a hydantoin group. FIG. 5*a* illustrates a generic first reagent, where $R_3$ & $R_4$ are glycidyl groups (a.k.a. epoxy groups), that are shown in FIG. 5B. The fifth position of the hydantoin ring has a carbon atom that may have a variety of alkyl groups, or none. The presence of alkyl groups tends to prevent crystallization. The first reagent is selected from a group consisting of diglycidyldi-methylhydantoin, diglycidyl diethylhydantoin, diglycidyl-ethyl-hydantoin, diglycidylmethyl hydantoin, diglycidylalkylhydantoin, diglycidyldialkyl hydantoin, 5-alkyl-1,3-diglycidyl-5-methylhydantoin, and 5-alkyl-1,3-diglycidyl-5-alkylhydantoin. FIG. 5*c* illustrates the structure of 5-ethyl-1,3-diglycidyl-5-methylhydantoin, which is known in industry as Araldite™ AY-238. The second reagent is a non-hygroscopic material that has at least two nucleophilic groups. Examples of second reagents that fall into this category are polyalkylenepolyamine. Polyoxypropylenepolyamine is suitable, while polyoxyethylenepolyamine is not, in part because it is not soluble in nonpolar reaction diluents. An exemplary polyoxypropylenepolyamine is polyoxypropylenetriamine, as it has about three nucleophilic groups, where each group has two nucleophilic sites. In a first reaction, as shown in FIG. 3 a primary amine reacts with an epoxide, and the formed secondary amine still has a hydrogen atom, and so it may react with another epoxide forming a tertiary amine. When all sites are reacted, there is the potential for forming about six crosslinks, which produce a highly resilient shell. Accordingly, this process is an in-situ process/reactions as the AN (or other salts) is coated with a hydantoin that specifically interacts and binds with a polar surface of the salt. This hydantoin also has free epoxy groups, which react with the tri-amine during the second step, and hence a coating shell. Both steps and reactions occur in a flask, or in situ. The salt is not treated with a fully cured polymer as this structure would only be considered a mixture or a blend.

While small levels of accelerants such as tris-(dimethylaminomethyl) phenol and nonyl phenol may be included, accelerants tend to increase gel. Second reagents that are polyamines generally already have the possibility for a high level of crosslinking, and which may result in gel.

Figure 4:
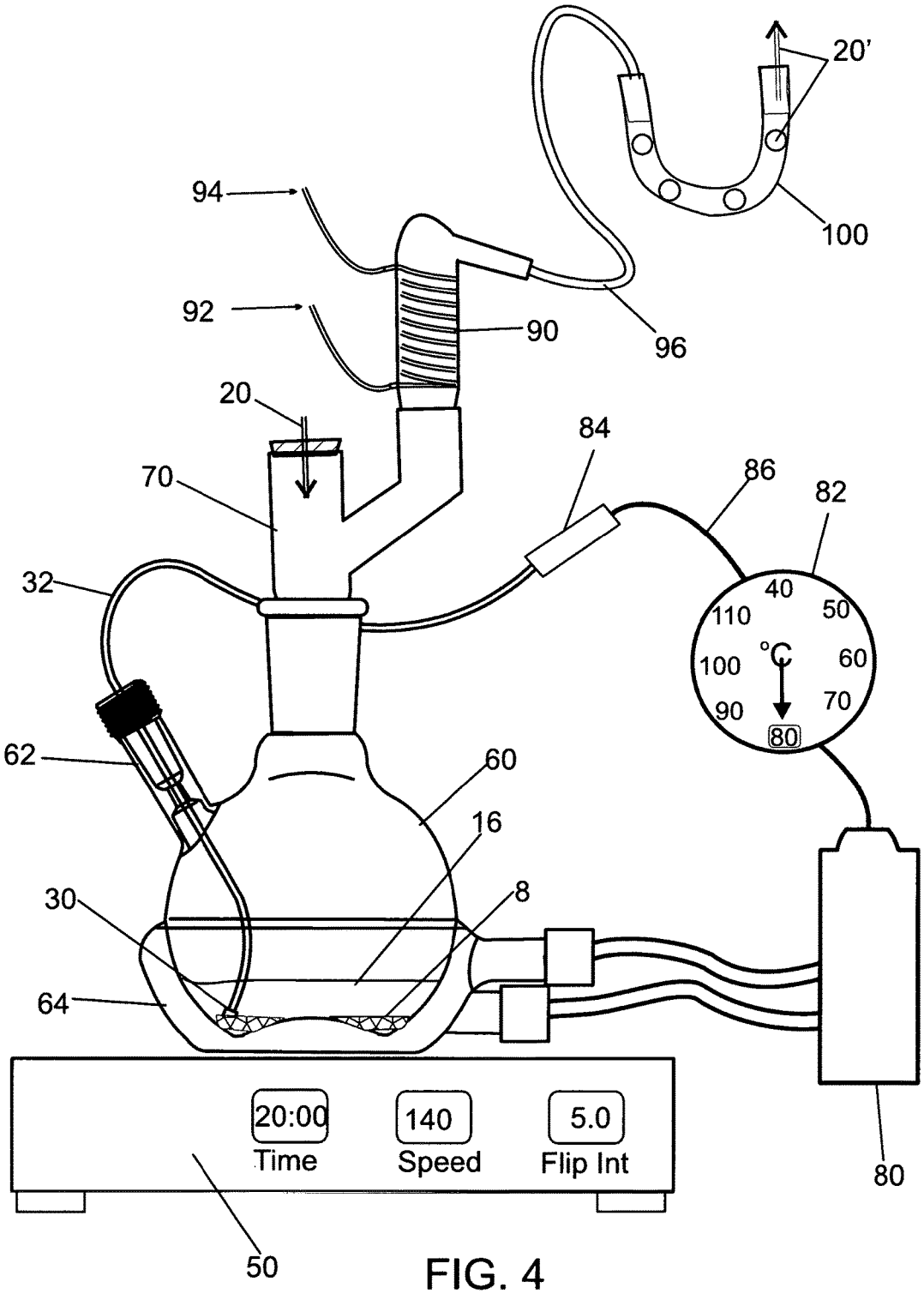
FIG. 4 is an illustrated embodiment of the process equipment found in a laboratory, including a Schlenk flask, an orbital shaker and a thermal fluid heater.

A Schlenk flask 60 is illustrated in FIG. 4, where the specific flask includes an indented bottom forming a concave interior. The flask 60 includes a sidearm inlet 62 through which may be secured the thermocouple leads 32 connected to the thermocouple 30 and a coupler 84. The flask 60 includes a jacketed bath 64 with a flat bottom. There is an inlet and an outlet for the jacketed bath, which are in fluid communication with a circulating thermal fluid heater 80. A regulator 82 allows the user to select a temperature set point. The set point is currently set at 80° C. The regulator 82 compares the internal temperature detected by the thermocouple 30 with the set point, and controls the circulating thermal fluid heater 80 as needed. The coupler 84 and the regulator 82 are in electrical communication via cable 86.

A quantity of prills 8 is shown in the flask 60 on either side of the concave indention. In an exemplary embodiment, the prills are ammonium nitrate (AN) prills. In other exemplary embodiments, the prills may be ammonium perchlorate (AP) prills or ammonium dinitramide (ADN) prills upon which the coating shell may be applied. The prills 8 are covered by the nonpolar reaction diluent 16. The prills 8 and nonpolar reaction diluent 16 are being gently stirred, in essence swirled, by an orbital shaker 50. The orbital shaker has various control parameters including a speed in rpm (currently set at 140), a run time in hours and minutes (currently set at 20:00), and a time duration between reversing the direction of revolution, for example rotation changes from clockwise to counter clockwise. This duration is sometimes called the flip interval, and it is set in minutes (currently set at 5.0 minutes).

The flask is currently fitted with a connecting adapter 70 with two upright connections, where one of the upright connections is fitted with a reflux condenser 90 cooled with water through the inlet 92 and outlet 94. The other upright connection is stoppered, and is an inlet for an inert gas. The inert gas is generally Argon, and it flushes the flask and exits through the reflux condenser 90 through line 96 connected to bubbler 100, exiting at 20'. The bubbler 100 provides a visual reference of the flow rate. For the illustrated embodiment, the bubbler 100 generally includes a thermal heating fluid, such as a silicone oil, or another similar thermal heating fluid having a low vapor pressure even when hot.

A hard vacuum may be created in the Schlenk flask 60 by removing the adapter 70 and the attachments; and connecting a vacuum line attached to a pump (not shown). Generally, a cold trap is situated between the flask and the pump. The cold trap is nominally cooled in a Dewar structure holding liquid nitrogen or a non-freezing liquid cooled with dry ice.

A group of individual shells may be formed en masse on a quantity of ammonium nitrate prills, where the total weight of the shells is less than 5% of the weight of dried AN prills. This structure requires that the first reagent includes a hydantoin moiety. The hydantoin moiety has a high affinity for AN, and after a relatively short time, in the presence of a nonpolar reaction diluent and dried AN prills, the first reagent deposits on the prill. These deposits establish desired reaction sites for the second reagents molecules.

In general, the lower the weight percent required, then the less unwanted gel is produced. As the exemplary embodiment below teaches, a total weight percent of about 1% creates no measurable quantity of gel in the reactive diluent. All the weight of the reacted first and second reagents has been incorporated into forming the shells.

Actual (Non-Theoretical) Exemplary Process

Figure 6A:
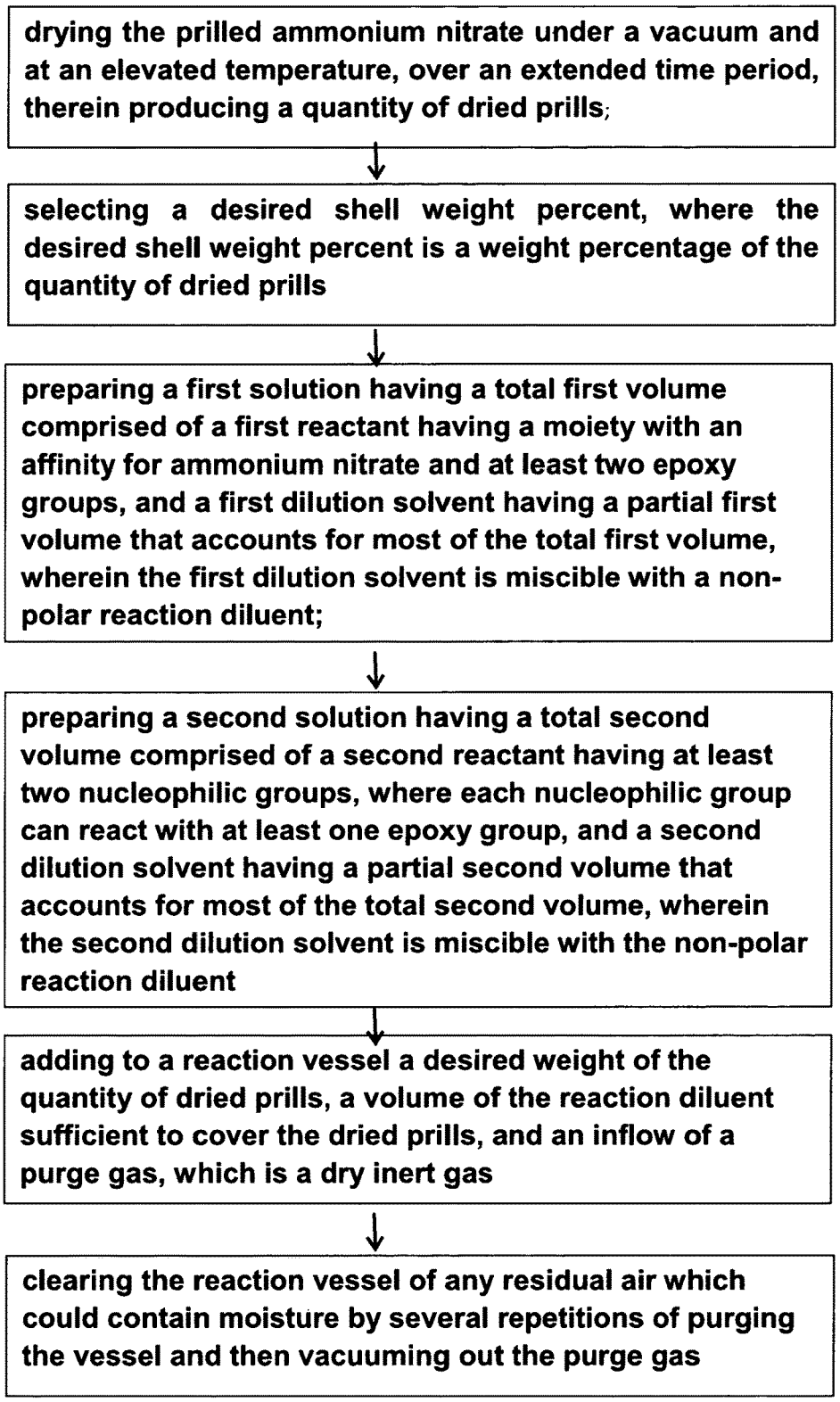
FIG. 6*a* illustrates the first six steps in the process.
Figure 6B:
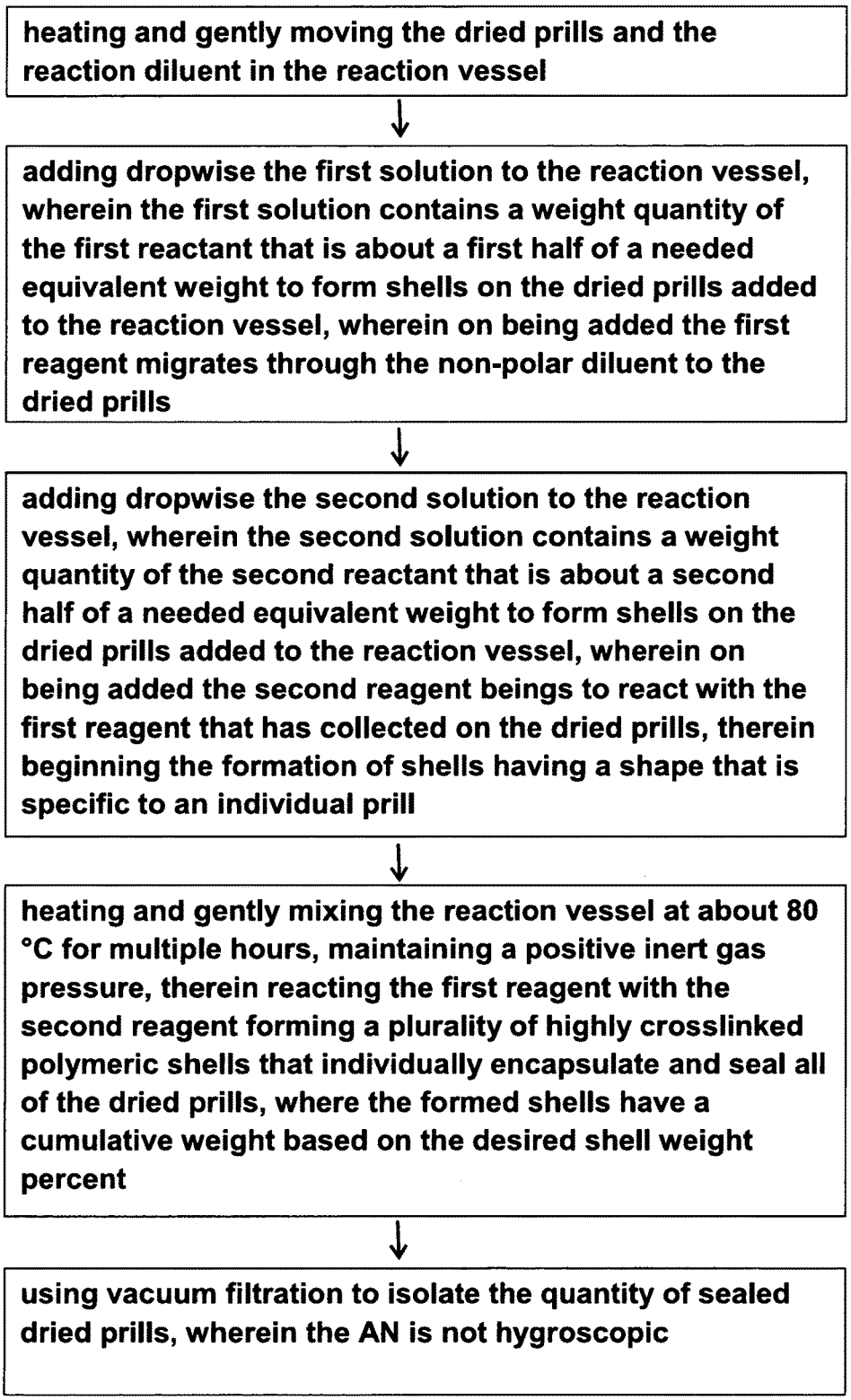
FIG. 6*b* illustrates the next five steps in the process.

The process used to form the shells is given in FIG. 6*a* and FIG. 6*b*.

An embodiment illustrating each step of forming a sealing shell that encases, that is, surrounds, a prill of ammonium nitrate, where the total shell weight was about 1% of the total weight of the dried AN prill follows. Individual shell were formed en masse on a quantity of ammonium nitrate prills, where the shell weight was about 1% of the AN weight. The shell was formed in situ by reacting a first reactant with a second reactant in the presence of the AN prills en masse. In the process, a first solution includes a first reagent, which was di-epoxy hydantoin compound (e.g., 5-ethyl-1,3-diglycidyl-5-methylhydantoin, Araldite™ AY-238 Huntsman, with a 127.14 epoxide equivalent weight) that was diluted in a dilution solvent, chloroform (about 30.5 mg/ml chloroform), forming the first solution. The first solution was dried using molecular sieve beads.

A second solution includes a second reagent, which was a polyoxypropylenetriamine compound (e.g., Jeffamine™ T-403, Huntsman, 81.4 amine hydrogen equivalent weight) that was diluted in chloroform (about 19.5 mg/ml chloroform) forming the second solution. The second solution was dried using molecular sieve beads.

Chloroform was selected as it was relatively non-hygroscopic, and formed a boiling point azeotrope with water, and the molecule chloroform was too large to be absorbed by the 3 Å activated sieve beads.

In terms of percent solids by weight, the first solution has a percent solids of about 2% [=100×0.0305/((1 ml*1.49 g/ml)+0.0305)]. The percent solids of the second solution is about 1.3% [=100×0.0195/((1 ml*1.49 g/ml)+0.0195)]

As previously stated, both the first and second solutions were dried over about 3 Å activated molecular sieves. The weight of the sieve beads was about 0.15 grams of sieve beads per ml of chloroform (~10% wt/vol). The drying time was about 3 days.

The ammonium nitrate was vacuum dried (about 5 Torr, about 100° C.) in an oven overnight (about 16 h). A relatively non-polar carrier solvent that is miscible with chloroform was dried over activated molecular sieves (3 Å, 10% wt/vol) for at least 3 days, so for 100 ml of heptane 10 g of activated sieve beads are used. Heptane was selected as its boiling point (98.42° C.) is high enough to push the reaction to completion, and still maintain the AN in the phase III α-rhombic crystalline state.

Air-free techniques were used. The glassware, including a Schlenk flask, syringes, and needles, were oven-dried (about 130° C.) overnight (about 16 h). As a reminder the Schlenk flask is a reaction vessel having a sidearm inlet that is usually fitted with an inlet valve (see FIG. 4).

In this exemplary embodiment the Schlenk flask was a 250 ml jacketed, flat-bottom flask, modified such that the flat-bottom was indented inwards forming a concave center with a perimeter groove. FIG. 4 illustrates the flask 60. The groove was filled to a depth of about 2 mm with about 5.00 g of the dried prilled ammonium nitrate. The prilled ammonium nitrate was cyclically purged with Argon (or another inert dry gas) and then vacuumed multiple times, therein removing any vestiges of water hygroscopically complexed to the ammonium nitrate.

To the Schlenk flask was added the dried heptane (about 50 ml). A reflux condenser was attached to an adapter, fitted on the flask, and a thermocouple lead 32 was inserted through the air-free valve side-arm 62 of the flask 60. Argon flowed from the top port, forming a slight pressure within the Schlenk flask as it was slightly constrained by a bubbler 100. The jacketed portion 64 was connected to a circulating bath 80 which was set to warm the mixture to about 80° C. (internal temperature), which was below the boiling point of heptane (bp. 98.42° C.). The Schlenk flask was placed on an orbital shaker. The mixture was gently shaken (140 rpm, reversing direction every 5 min) under positive Argon flow for 1 hour.

The first solution (1.00 ml, 30.5 mg, 0.2398 meq.) was added dropwise over 1 minute. The addition can be made using a syringe. Next, the second solution (1.00 ml, 19.5 mg, 0.2395 meq.) was added dropwise over 1 minute, and the mixture was shaken at 80° C. overnight (about 20 h) under positive Argon flow, curing the coating to completion. After the mixture was cooled to room temperature, the yellow coated ammonium nitrate prills were isolated via vacuum filtration (Whatman #1 filter) using a dry pump. In the final step the prills were dried under high vacuum (0.1 Torr) in a conductive container overnight (about 16 h). The total mass was about 5.05 g; so there was been an increase in weight of 1% (5.00 g is now 5.05 g).

The calculation of the quantity needed for the first and second reactant is as follows. For a 1% coating weight, the total coating weight is 0.01×5 g=0.05 g. The first (epoxide) reagent and second (amine) reagent have an equal number of equivalents, or an equivalent weight ratio of 1:1. So half the equivalents are the first reagent and the other half are the second reagent. The Jeffamine™ T-403 has an amine hydrogen equivalent weight of 81.4 grams/equivalent. The 5-ethyl-1,3-diglycidyl-5-methylhydantoin has an epoxide equivalent weight of 127.14 g/equivalent. The fraction of the coating that is epoxide can be calculated by multiplying the total coating weight by the epoxide fraction of the total. The total weight of epoxide is 0.05×127.14/(127.14+81.4)=0.03048 g=30.48 mg (about 30.5 mg). The amine fraction is 0.05 g−0.030484 g=0.01952 g=19.52 mg (about 19.5 mg). As previously shown the reagents are dissolved in a dilution solvent to facilitate drying using molecular sieve beads.

Actual Test Results

In subsequent testing to determine how hygroscopic the coated prills are were kept under an atmosphere of 55% humidity (saturated aqueous solution of sodium bromide) at room temperature. Previously dried uncoated prills were used as a control. After 300 days, there was no weight change (i.e., uptake of water). As to the control, significant weight uptake occurs for the uncoated prills in less than 1 day. After several days the uncoated prills (control) had transformed into a saturated aqueous solution of ammonium nitrate.

In a second example of the process of coating forming a shell protecting a prill, the shells have a total weight that is about 2% of the weight of the ammonium nitrate. Similar properties were obtained. The weight increased from about 5.00 grams to about 5.10 grams, and the high humidity aged coated prills were not hygroscopic, and did not change in weight.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. An in-situ process for converting a prilled ammonium nitrate to a quantity of sealed prills, where the quantity of sealed prills are non-hygroscopic, comprising:

drying the prilled ammonium nitrate under a vacuum and at an elevated temperature, over an extended time period, therein producing a quantity of dried prills;

selecting a desired shell weight percent, where the desired shell weight percent is a weight percentage of the quantity of dried prills;

preparing a first solution having a total first volume comprising a first reactant having a moiety with an affinity for ammonium nitrate and at least two epoxy groups, and a first dilution solvent having a partial first volume accounting for most of the total first volume, wherein the first dilution solvent is miscible with a nonpolar reaction diluent;

preparing a second solution having a total second volume comprising a second reactant having at least two nucleophilic groups, wherein each of said at least two nucleophilic group reacts with at least one epoxy group, and a second dilution solvent having a partial second volume that accounts for most of the total second volume, and wherein the second dilution solvent is miscible with the nonpolar reaction diluent;

adding to a reaction vessel a desired weight of the quantity of dried prills, a volume of the reaction diluent sufficient for covering the dried prills, and an inflow of a purge gas, which is a dry inert gas;

clearing the reaction vessel of any residual air, which contains moisture, by several repetitions of purging the vessel and vacuuming out the purge gas;

heating and gently moving the dried prills and the reaction diluent in the reaction vessel;

adding dropwise the first solution to the reaction vessel, wherein the first solution contains a weight quantity of the first reactant that is about a first half of a needed equivalents to form shells on the dried prills added to the reaction vessel, and wherein when added the first reactant migrates through the nonpolar reaction diluent to the dried prills;

adding dropwise the second solution to the reaction vessel, wherein the second solution contains a weight quantity of the second reactant that is about a second half of a needed equivalents to form shells on the dried prills added to the reaction vessel, wherein when added the second reactant reacts with the first reactant that has collected on the dried prills, therein beginning an in-situ formation of shells having a shape that is specific to an individual prill;

heating and gently mixing the reaction vessel at about 80° C. for multiple hours, maintaining a positive inert gas pressure, therein reacting in-situ the first reagent with the second reagent forming a plurality of highly crosslinked polymeric shells for individually encapsulating and sealing all of the dried prills, wherein the formed plurality of highly crosslinked polymeric shells have a cumulative weight based on the desired shell weight percent; and using vacuum filtration for isolating the quantity of sealed dried prills, wherein the AN is not hygroscopic.

2. The process according to claim 1, wherein the first reagent is a diglycidyl hydantoin, wherein hydantoin includes a strong affinity for AN.

3. The process according to claim 2, wherein the first reagent is 5-ethyl-1,3-diglycidyl-5-methylhydantoin.

4. The process according to claim 1, wherein the first reagent is selected from group consisting of diglycidyldimethylhydantoin, diglycidyldiethylhydantoin, diglycidylethyl-hydantoin, diglycidylmethylhydantoin, diglycidylalkylhydantoin, diglycidyldialkylhydantoin,5-alkyl-1,3-diglycidyl-5-methylhydan-toin, 5-alkyl-1,3-diglycidyl-5-alkylhydantoin.

5. The process according to claim 1, wherein said at least two nucleophilic groups are amines.

6. The process according to claim 1, wherein the second reagent is a polyoxypropylenetriamine with an amine hydrogen equivalent weight of about 81 g/eq.

7. The process according to claim 1, wherein the first dilution solvent is chloroform.

8. The process according to claim 1, wherein the second dilution solvent is chloroform.

9. The process according to claim 1, wherein the nonpolar reaction diluent is a heptane.

10. The process according to claim 1, wherein the reaction vessel is a Schlenk flask.

11. The process according to claim 1, wherein the reaction vessel is agitated using an orbital shaker rotating at about 140 rpm, and reversing about every 5 minutes.

12. The process according to claim 1, wherein the multiple hours is about 20 hours of heating and gently mixing the reaction vessel at about 80° C.

13. The process according to claim 1, wherein the inert gas is Argon.

14. The process according to claim 1, is further comprising drying the first solution using about a 3 Å activated molecular sieve beads, where about 1 gram of beads is being added for every 10 ml of the first solution.

15. The process according to claim 1, wherein the desired shell weight percent is between a range of about 0.5% to about 4.0%.

16. The process according to claim 15, wherein the desired shell weight percent is between a range of about 1.0% to about 2.0%.

17. The process according to claim 1, further comprising drying the second solution using about a 3 Å activated molecular sieve beads, where about 1 gram of beads is added for every 10 ml of the first solution.

18. The process according to claim 1, wherein for a desired shell weight of 1%, and about 5.00 grams of dried prills then about 30.5 mg of the first reagent that is 5-ethyl-1,3-diglycidyl-5-methylhydantoin is dissolved in about 1 ml of chloroform, which is about a 2% solids solution.

* * * * *